United States Patent [19]

Alig

[11] Patent Number: 4,745,331

[45] Date of Patent: May 17, 1988

[54] COLOR PICTURE TUBE HAVING AN INLINE ELECTRON GUN WITH AN EINZEL LENS

[75] Inventor: Roger C. Alig, West Windsor Township, Mercer County, N.J.

[73] Assignee: RCA Licensing Corporation, Princeton, N.J.

[21] Appl. No.: 75,783

[22] Filed: Jul. 20, 1987

[51] Int. Cl.[4] ..... H01J 26/62

[52] U.S. Cl. ..... 313/414

[58] Field of Search ..... 313/414

[56] References Cited

U.S. PATENT DOCUMENTS

| | | | |
|---|---|---|---|
| 3,448,316 | 6/1969 | Yoshida et al. | 313/414 X |
| 3,898,521 | 8/1975 | Saito et al. | 315/370 |
| 3,949,262 | 4/1976 | Ohkoshi et al. | 313/414 X |
| 4,178,532 | 12/1979 | Fukuzawa et al. | 313/414 |
| 4,232,246 | 11/1980 | Sakurai et al. | 313/414 |
| 4,686,420 | 8/1987 | Kamohara | 313/414 X |

*Primary Examiner*—Palmer C. DeMeo

*Attorney, Agent, or Firm*—Eugene M. Whitacre; Dennis H. Irlbeck

[57] ABSTRACT

The present invention provides an improvement in color picture tubes. Such tubes include an electron gun for generating and directing three inline electron beams, a center beam and two side beams, along initially coplanar paths toward a screen of the tube. The gun includes a plurality of spaced electrodes which form a main focus lens for focusing the electron beams. The improvement comprises the plurality of spaced electrodes which form a main focus lens including three electrodes that form an einzel lens in the path of each electron beam. A first einzel lens electrode includes three inline cylinders through which the electron beams pass. A second einzel lens electrode includes a large oval cylinder that overlaps all three cylinders of the first einzel lens electrode. A third einzel lens electrode includes three inline cylinders which are overlapped by the oval cylinder. The oval cylinder includes means for shaping the main focus lens to focus the three electron beams stigmatically near ground potential and to converge the outer beams at the center of the screen.

3 Claims, 5 Drawing Sheets

COLOR PICTURE TUBE HAVING AN INLINE ELECTRON GUN WITH AN EINZEL LENS

This invention relates to color picture tubes having inline electron guns and, particularly, to an inline gun having an einzel lens as a main focus lens and means for shaping the field of the main focus lens.

An einzel lens, also called a saddle lens or a unipotential lens, is an electrostatic lens formed by three electrodes, a center electrode and two side electrodes. The center electrode is either connected to a ground potential or to a relatively low voltage potential. The two side electrodes are connected to a relatively high potential which usually is the anode potential. The focus of an einzel lens is slightly less sharp than that of a bipotential lens, but the einzel lens has the advantage that it does not require a second high voltage for a focus electrode. Einzel lens electron guns have been commercially used in color picture tubes, such as in the G. E. Portacolor, the RCA 15NP22 and the Sony Trinitron. The RCA 15NP22 had a delta electron gun and the G. E. Portacolor and Sony Trinitron used inline guns. The RCA and G. E. electron guns had individual tubular electrodes as the center and side electrodes in the paths of each electron beam. The Sony electron gun had large tubular electrodes as the center and side electrodes through which the three electron beams passed, crossing over each other at the center of the einzel lens.

SUMMARY OF THE INVENTION

The present invention provides an improvement in color picture tubes. Such tubes include an electron gun for generating and directing three inline electron beams, a center beam and two side beams, along initially coplanar paths toward a screen of the tube. The gun includes a plurality of spaced electrodes which form a main focus lens for focusing the electron beams. The improvement comprises the plurality of spaced electrodes which form a main focus lens including three electrodes that form an einzel lens in the path of each electron beam. A first einzel lens electrode includes three inline cylinders through which the electron beams pass. A second einzel lens electrode includes a large oval cylinder that overlaps all three cylinders of the first einzel lens electrode. A third einzel lens electrode includes three inline cylinders which are overlapped by the oval cylinder. The oval cylinder includes means for shaping the main focus lens to focus the three electron beams stigmatically near ground potential and to converge the outer beams at the center of the screen.

DETAILED DESCRIPTION OF THE PREFERRED EMBODIMENT

Figure 1:
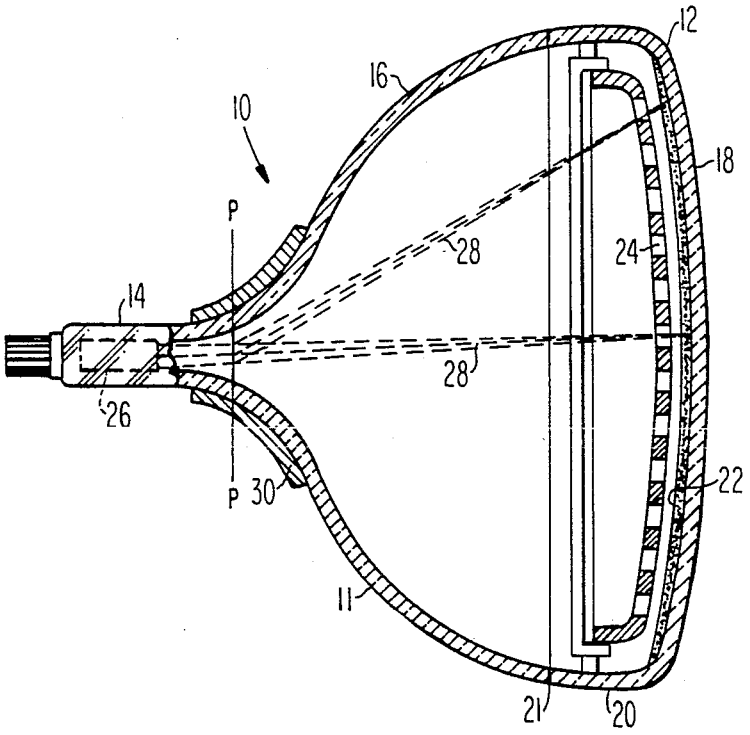
FIG. 1 is a plan view, partly in axial section, of a shadow mask color picture tube embodying the invention.
Figure 2:
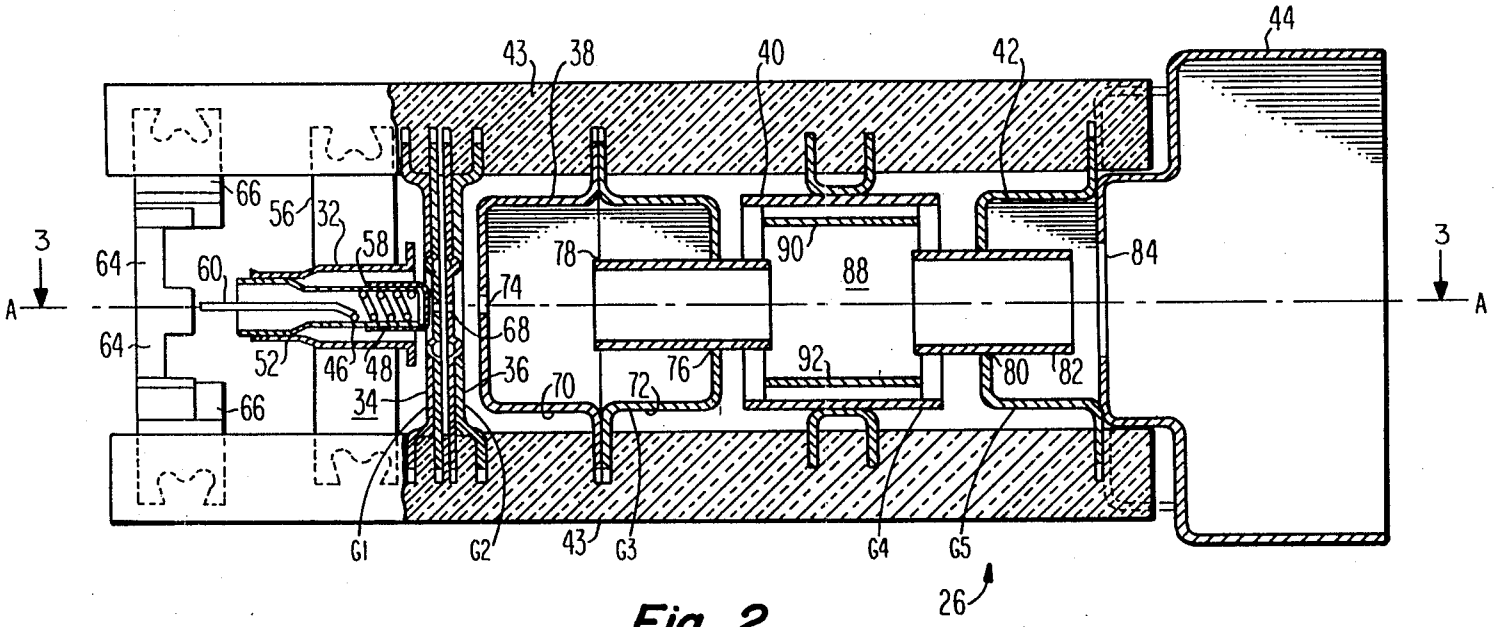
FIGS. 2 and 3 are axial section side and top views, respectively, of the electron gun shown in dashed lines in FIG. 1.
Figure 3:
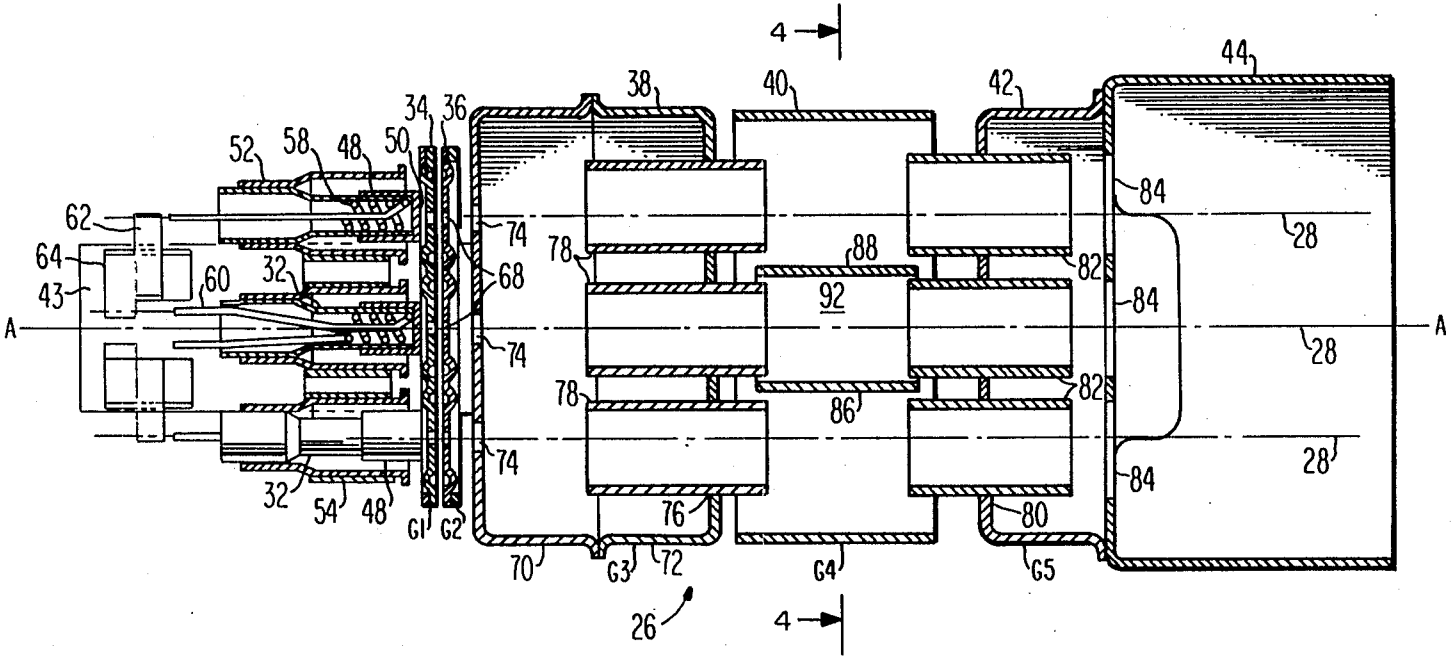
Figure 4:
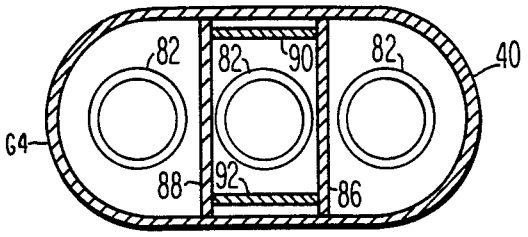
FIG. 4 is a sectional view of the electron gun taken at line 4—4 of FIG. 3.
Figure 5:
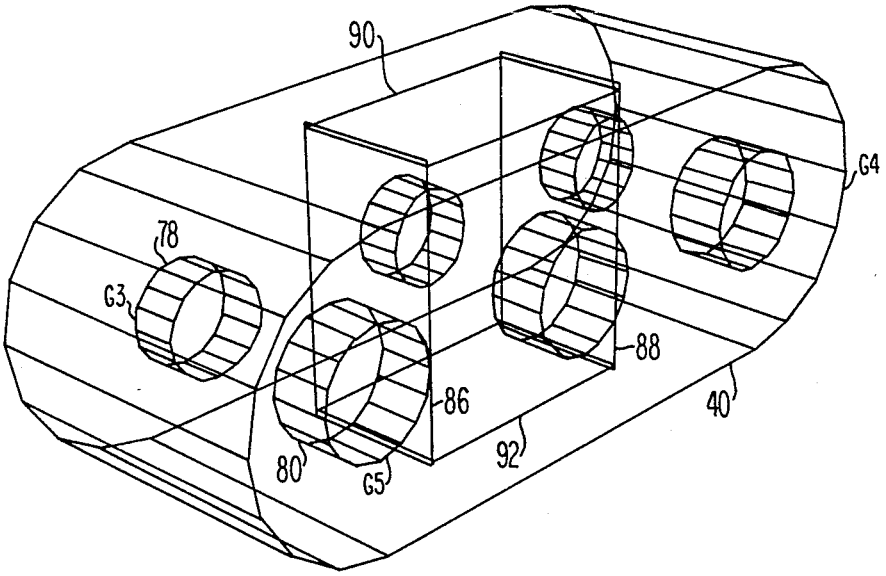
FIG. 5 is a perspective line drawing of the main focusing lens electrodes of the electron gun of FIGS. 2 and 3.

FIG. 1 shows a rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P-P in FIG. 1 at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1.

The details of the gun 26 are shown in FIGS. 2, 3, 4 and 5. The gun 26 comprises three equally spaced coplanar cathodes 32 (one for each beam), a control grid electrode 34 (G1), a screen grid electrode 36 (G2), a first einzel lens electrode 38 (G3), a second einzel lens electrode 40 (G4) and a third einzel lens electrode 42 (G5), spaced in the order named and attached to two support rods 43. A shield cup 44 is attached to the G5 electrode 42 at the beam exit end of the gun.

The cathodes 32, the G1 electrode 34, the G2 electrode 36 and the side of the G3 electrode 38 facing the G2 electrode 36 comprise the beam forming region of the electron gun 26. The G3 electrode 38, the G4 electrode 40 and the G5 electrode 42 comprise the main focusing lens portion of the gun 26. The main focusing lens is a unipotential type, usually called an einzel lens. In this gun, the G3 electrode 38 is electrically connected to the G5 electrode 42 which, in turn, is connected to the anode potential. The G4 electrode 40 is either connected to ground or is connected to a low potential compared to the anode potential.

Each cathode 32 comprises a cathode sleeve 46, closed at the forward end by a cap 48 having an end coating 50 of electron emissive material and a cathode support tube 52. The tubes 52 are supported on the rods 43 by four straps 54 and 56. Each cathode 32 is indirectly heated by a heater coil 58 positioned within the sleeve 46 and having legs 60 welded to heater straps 62 and 64 mounted by studs 66 on the rods 43. The control and screen grid electrodes, 34 and 36, are two closely-spaced flat plates having three pairs of small aligned apertures 68 centered with the cathode coatings 50 to initiate three equally-spaced coplanar electron beams 28 extending toward the screen 22. Preferably, the initial electron beam paths are substantially parallel, with the middle path coincident with the central axis A-A.

The G3 electrode 38 comprises two cup-shaped elements 70 and 72 joined at their open ends. The first element 70 has three medium size apertures 74 facing the G2 electrode 36 that are aligned with the initial electron beam paths. The second member 72 has three large apertures 76 also aligned with the electron beam paths. Three cylinders 78 are fixed within the three apertures 76 so that portions of each cylinder 78 extend beyond the element 72 into the G4 electrode 40. The G4 electrode 40 is a large cylinder having a somewhat oval cross-section. The G5 electrode 42 is cup-shaped having three large apertures 80 facing the G3 electrode 38. The apertures 80 are slightly larger in diameter than are the apertures 76 in the G3 electrode 38. Three cylinders 82 are fixed within the apertures 80 and extend into the G4 electrode 40. The shield cup 44 is attached to the open end of the G5 electrode 45 and includes three apertures 84 also aligned with the electron beam paths.

Attached to the inside of the G4 electrode 40 are four field former plates 86, 88, 90 and 92. Two plates 86 and 88 are parallel to each other and are located between the side beam paths and the center beam path. These plates extend perpendicularly to the inline direction of the inline electron beams. The other two plates 90 and 92 are connected between the two plates 86 and 88 in parallel relationship to each other on opposite sides of the center beam path. These plates 90 and 92 extend parallel to the inline direction of the inline electron beams.

The field former plates 86 and 88, that are located between the electron beam paths, serve two functions. First, the vertical plates 86 and 88 contour the electrostatic field lines so that the center electron beam is focused in the horizontal (in the inline direction of the inline beams) direction. Without the plates 86 and 88, the horizontal equipotential electrostatic field lines would be essentially flat at the center beam path. Second, the plates 86 and 88 cause a curvature of the horizontal electrostatic field lines at the side beam paths so that the side beams are converged inwardly towards the center beam.

The horizontal field former plates 90 and 92 are positioned to control the focusing of the center beam in the vertical direction. Such control is required in the embodiment shown to compensate for the slightly weaker vertical focus field at the center beam path than at the side beam paths and to balance the vertical field with the horizontal field at the center beam path.

Figure 6:
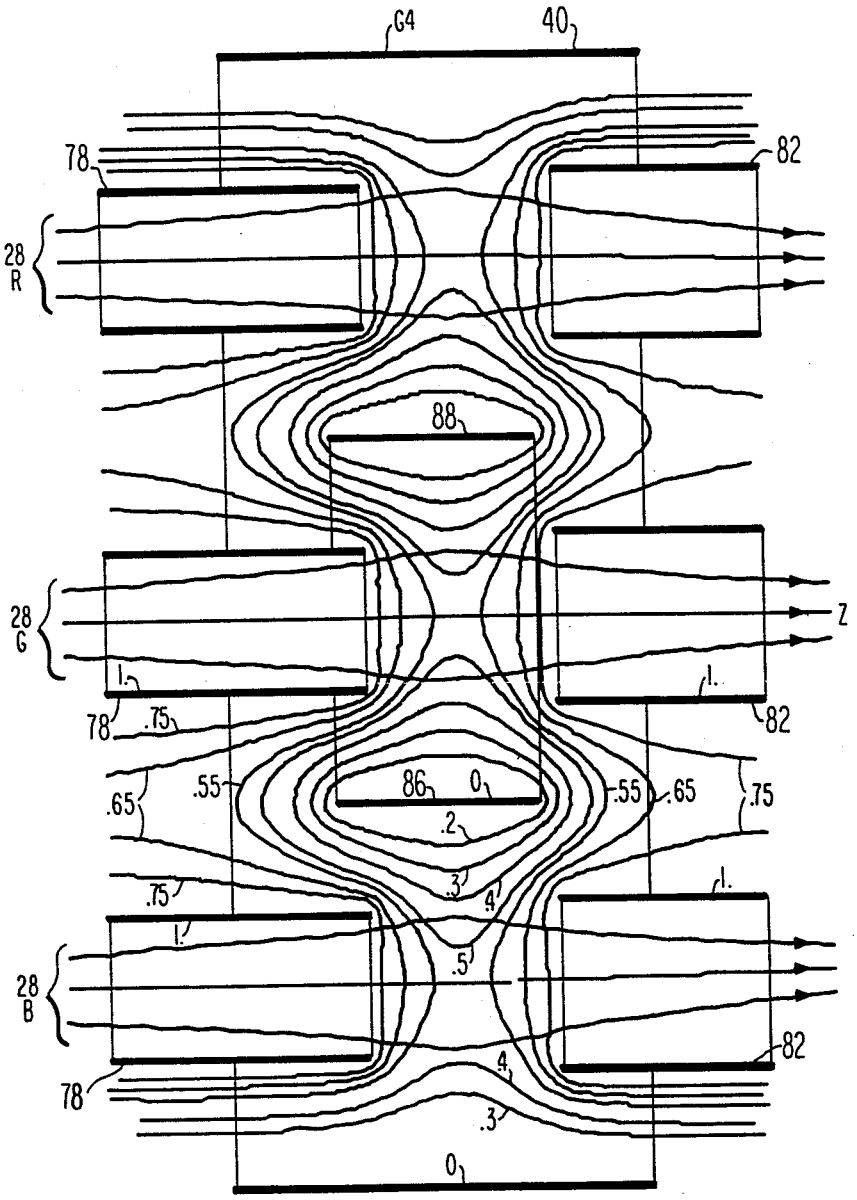
FIG. 6 is a schematic top view of the einzel lens of the electron gun of FIGS. 2 and 3 showing the horizontal electrostatic field lines.

Selected electrostatic equipotential lines in the horizontal plane, along with selected electron trajectories from the beams 28 in this plane are shown in FIG. 6. The beams 28 enter the einzel lens through the G3 cylinders 78 and exit through the G5 cylinders 82. Three beams, 28R, 28G, and 28B, excite the red, green and blue phosphors on the screen 22. The einzel lens is formed by the oval cylinder 40 and the field former plates, 86 and 88, of the G4 electrode. This electrode is at low voltage, set here to 0 volts. The G3 and G5 electrodes, 78 and 82, are set to a high potential. Since the equipotentials and electron trajectories scale with the magnitude of this high potential, this potential is arbitrary and was chosen to be 1 volt. Equipotentials at 20, 30, 40, 50, 55, 65, and 75 percent of the high potential are shown in FIG. 6. These equipotentials characterize the electron lenses which focus the beams 28 onto the screen 22. Thus, in the absence of a magnetic deflection field, the trajectories of the center beam 28G are focused symmetrically about the central trajectory, which is coincident with the tube axis A-A, labelled Z in FIG. 6. The asymmetry between the oval cylinder 40 and the field former 88 causes the central trajectory of the side beam 28R to be converged inwardly toward the center beam 28G. The other trajectories of the side beams are focused at the screen.

What is claimed is:

1. In a color picture tube including a neck, a funnel and a faceplate and having an inline electron gun in said neck for generating and directing three inline electron beams, a center beam and two side beams, along initially coplanar paths toward a screen of said tube, said gun including a plurality of spaced electrodes which form a main focus lens for focusing said electron beams, the improvement comprising said plurality of spaced electrodes which form a main focus lens including three electrodes that form an einzel lens in the path of each electron beam, a first of the einzel lens electrodes including three inline cylinders through which the electron beams pass, a second of the einzel lens electrodes including a large oval cylinder that overlaps portions of all three cylinders of the first of the einzel lens electrodes, a third of the einzel lens electrodes including three inline cylinders which are partially overlapped by said oval cylinder, and said first and third einzel lens electrodes being electrically connected, and means connected to the oval cylinder for shaping the main focus lens to focus the three electron beams stigmatically near ground potential and to converge the outer beams at the center of the screen.

2. The tube as defined in claim 1, wherein said shaping means includes conductive plates located within the oval cylinder.

3. In a color picture tube including a neck, a funnel and a faceplate and having an inline electron gun in said neck for generating and directing three inline electron beams, a center beam and two side beams, along initially coplanar paths toward a screen of said tube, said gun including a plurality of spaced electrodes which form a main focus lens for focusing said electron beams, the improvement comprising said plurality of spaced electrodes which form a main focus lens including three electrodes that form an einzel lens in the path of each electron beam, a first of the einzel lens electrodes including three inline cylinders through which the electron beams pass, a second of the einzel lens electrodes including a large oval cylinder that overlaps portions of all three cylinders of the first of the einzel lens electrodes, a third of the einzel lens electrodes including three inline cylinders which are partially overlapped by said oval cylinder, said first and third einzel lens electrodes being electrically connected, and four field former plates internally connected to said oval cylinder, two of said plates located on opposite sides of the center beam path paralleling each other and the plane of the initially coplanar electron beams and two other plates located on opposite sides of the center beam path between the center beam path and the side beam paths paralleling each other and being perpendicular to the plane of the initially coplanar electron beams.

* * * * *